United States Patent [19]

Thompson

[11] Patent Number: 4,911,376

[45] Date of Patent: Mar. 27, 1990

[54] EXPANDABLE SHAFT

[76] Inventor: Johnnie W. Thompson, 441 Highway 418, Pelzer, S.C. 29669

[21] Appl. No.: 244,097

[22] Filed: Sep. 14, 1988

[51] Int. Cl.[4] ..... B65H 75/24

[52] U.S. Cl. ..... 242/72.1

[58] Field of Search ..... 242/72 R, 72.1; 279/2 R

[56] References Cited

U.S. PATENT DOCUMENTS

| | | | |
|---|---|---|---|
| 4,254,920 | 3/1981 | Peterson | 242/72.1 |
| 4,433,814 | 2/1984 | Pontes et al. | 242/72.1 |
| 4,492,346 | 1/1985 | Young | 242/72.1 |
| 4,773,656 | 9/1988 | Chlupsa | 242/72 R X |

FOREIGN PATENT DOCUMENTS

| | | | |
|---|---|---|---|
| 873891 | 8/1961 | United Kingdom | 242/72.1 |

*Primary Examiner*—John M. Jillions
*Attorney, Agent, or Firm*—Cort Flint

[57] ABSTRACT

An expandable shaft (B) is disclosed having one or more spaced expansion units (A) which contain swage pins (10) that are expanded radially by wedge members (14). Operators (D, E, F) are used to move the wedge members axially to expand and retract the pins. In a preferred form, the operator includes an operator member (30) which may be rotated to move an operator rod (38) axially. The operator member (30) has a first axial position in which the operator member rotates to move wedge member axially and a second axial position in which the operator rod is positively locked against rotation so that the operator cannot turn to loosen the clamping action of the pin against a core.

15 Claims, 2 Drawing Sheets

EXPANDABLE SHAFT

BACKGROUND OF THE INVENTION

The invention relates to an expandable shaft for releasably engaging a tubular core about which a web is wound, for example cloth wound on a cloth winding machine. In particular, the invention relates to improved operators for actuating an expandable shaft.

Prior expandable shafts are known, for example, in related U.S. Pat. Nos. 4,492,346 and 4,469,288, which use operator rods moving axially to cause core engagers to move radially to lock within and against the core. A drive screw threaded in a journal abuts the operator rod to move it axially to engage the core engagers. The rod is returned under spring pressure. An arrangement of pressure washers are used to dampen vibrations and prevent the drive screw from loosening and retracting in use. Other operator devices for expandable shafts and mandrels are disclosed in U.S. Pat. Nos. 3,722,808, 3,331,565, 2,670,905, and 2,394,503. U.S. Pat. No. 2,394,503 uses air to move an operator rod for expanding members to engage a core. U.S. Pat. No. 3,331,565 and 2,670,905 use manual buttons to operate an expandable shaft. U.S. Pat. No. 3,722,808 discloses a rather complex air operator for an expandable shaft which uses a compression spring to retain the shaft expanded and air pressure to release the shaft. The mechanical operators of the prior art have lacked simple reliable operators having a positive locking of a shaft in its expanded position. The actuator mechanisms acted upon by the operators to expand the shaft or mandrels have tended to be too complex for the rather simple application being made.

Accordingly, an object of the invention is to provide a simple and reliable operator for an expandable shaft which may be positively locked to prevent the operator from loosening during operation.

Another object of the invention is to provide an expansion unit for actuating an expandable shaft which is simple in construction and operation and may be duplicated along the length of the shaft to provide as many units as needed for the particular application being made.

Another object of the invention is to provide improved manual and automatic operators for an expandable shaft having expansion units which more simply and reliably expand the shaft in response to the operator.

Still another object of the invention is to provide automatic and manual fluid operators for use with expansion units for expanding a shaft on a winding stand and the like.

SUMMARY OF THE INVENTION

The above objectives are accomplished according to the invention by providing a radially expanding shaft for engaging an inner core of wound material and the like which includes a cylindrical shaft and operator rod carried coaxially within the shaft. At least one expansion unit is carried within the shaft connected to the operator rod for expanding the shaft radially. An operator means is connected to the operator rod which includes an operator member movable axially with respect to the shaft. The operator member has a first position in which the shaft may be rotated to cause the expansion unit to expand and retract the shaft radially. The operator member has a second axial position in which the operator member and rod are positively locked against rotation to maintain the shaft expanded. At least one expansion unit is carried within the expandable shaft which has a retaining socket. A plurality of radially expandable pins are carried by the retaining socket for reciprocating radial movement. A corresponding number of wedges are carried by the retaining socket for engaging respective ones of the pins for urging the pins in an outward radial direction. A slot is formed in the retaining socket for slidably receiving the wedges in an axial direction.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
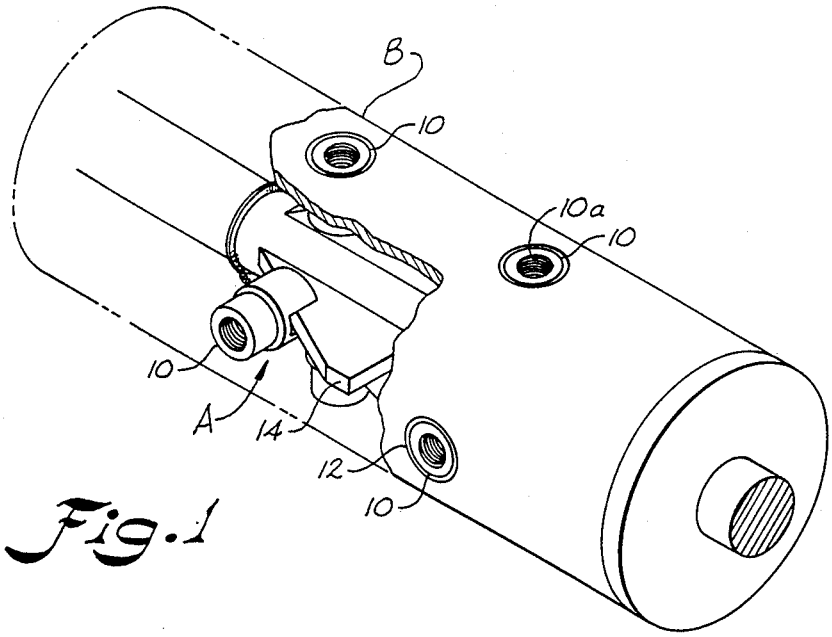
FIG. 1 is a perspective view of an expandable shaft constructed according to the invention.

Referring now in more detail to the drawings, a dual wedge expansion unit, designated generally as A, is illustrated which includes four expansion swage pins 10 which may be used in different applications to clamp cores used in industries in winding or unwinding material on an expandable shaft. The swage pins may be used alone or in combination with an attached sleeve to clamp a core. Expansion unit A is assembled externally and inserted into a shaft B with swage pins 10 aligned with holes 12 through the shaft so that they can expand beyond the outside diameter of shaft B. As can best be seen in FIGS. 1–3, dual wedge expansion unit A includes swage pins 10, dual wedge 14, and a retaining socket 16. Retractor springs 18 urge pins 10 radially inwards when a force is applied to dual wedge 14 in a first direction of arrow "a". A movement of dual wedge 14 in a second direction of arrow "b" is provided which urges the dual wedge in contact with swage pins 10 and forces swage pins 10 radially outward from the center of socket 16. A force in direction "a" moves dual wedge 14 in the second, retraction direction which allows swage pins 10 to release from a clamping position.

Swage pins 10 are held in place by holes 20 in socket 16. Dual wedge 14 is held in place by slots 22 in socket 16. Springs 18 attach to plate 24 and swage pins 10 by any suitable classical method. Springs 18 retract swage pins 10 as dual wedge 14 is moved in direction "a". Swage pins 10 can be used as a solid end or drilled and taped at **10*a* for use as a nut for bolting external accessories such as leafs 26 (FIG. 4) to the shaft for retraction and expansion. A single dual wedge unit A can be coupled by an operator rod C through a hole 28 in the dual wedge 14 to provide a series of expansion units to any desired length of an expandable shaft. Each dual wedge unit A includes a first wedge member 14a and a second wedge member 14b which urge four swage pins 10** radially outwards to expand shaft B. Alternately, a wedge unit with only a single wedge may be used to expand two pins. A second wedge unit down line may be used with a single wedge rotated ninety degrees to expand a second set of pins radially and orthogonal to the first set. Any number of variations are possible to satisfy the particular application being made.

Figure 4:
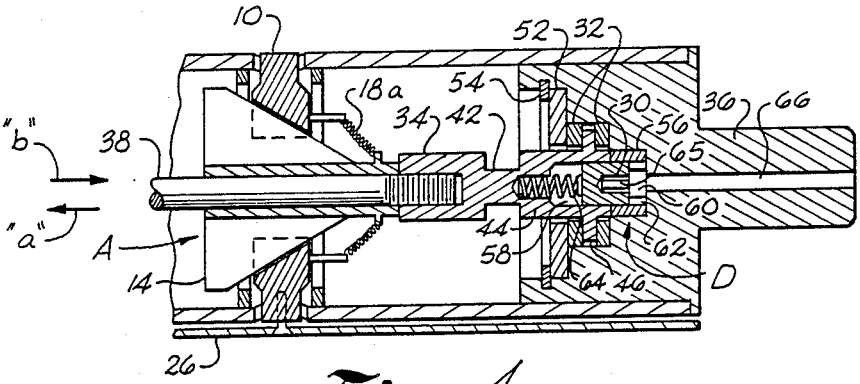
FIG. 4 is a sectional view of another embodiment of an expandable shaft according to the invention.

As can best be seen in FIG. 4, a preferred embodiment of a mechanical operator means, designated generally as D, is shown which provides expansion of dual wedge expansion unit A. In this case, expansion unit A is turned 180 degrees. The operator means is made up in four main sections; a locking nut 30, bearing 32, coupling 34, and journal head 36. A dual wedge connecting rod 38 screws into coupling nut 34. A neck 42 of coupling 34 is rigidly attached to a housing 44. A housing flange 46 is meshed between two thrust bearings 32 which allows rotation of these parts. Thrust bearings 32 are held in position by spacer 52 and retaining ring 54. A female hex socket 56 is pressed into journal head 36 which provides a locking member. Locking hex nut 30 moves between a first axial position entirely within a socket slot 58 in housing 44 which allows dual wedge movement, and a second axial position in which locking nut 30 occupies a part of socket slot 58 and a part of a socket slot 60 in female hex slot 56. Abutments 62 limit the rightward movement of locking nut 30. Locking occurs when the slots 58 and 60 are aligned which allows the nut 30 to rest mid way between female slot 56 and housing 44. Spring 64 provides force to keep nut 3 in locked position against abutments 62 (FIG. 4).

In operation, a standard allen wrench (not shown) is inserted into the socket 65 through hole 66 in journal 36 to expand shaft B. A slight push on the allen wrench overrides spring 64 allowing nut 30 to slide out of the lock position. Turning the allen wrench now rotates coupling 34 which turns connecting rod 38 that creates axial movement of operator rod 38 and dual wedge 14 in or out of socket 16 creating expansion or retraction of the swage pins 10. Movement of rod 38 in the direction "b" expands pins 10 and movement in direction "a" allows pin retraction under the force of springs 18a.

Figure 2:
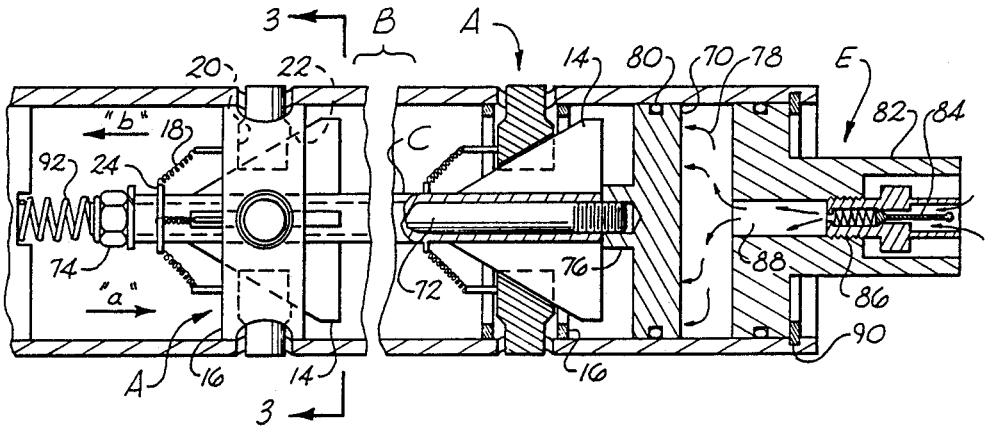
FIG. 2 is a sectional view of an expandable shaft according to the invention.
Figure 3:
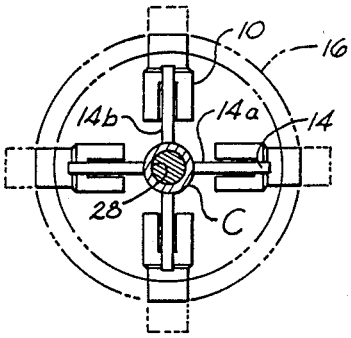
FIG. 3 is a sectional view taken along line 3—3 of FIG. 2.

As can best be seen in FIG. 2, an assembly of dual wedge expansion unit A in a shaft B is illustrated which uses a cylinder piston 70 connected to a dual connecting rod 72 to provide operating force by use of air pressure applied from one end of shaft B. Dual wedge units A are connected and held together by connecting rod 72, nut 74 and 76. Piston 70 moves in space 78. Air seals are made by "O" rings 80. A shaft journal 82 provides an air inlet by a conventional air valve 84 which mounts at threads 86. Hole 88 allows air into space 78. Retainer ring 90 holds journal 82 in shaft B. When air is applied at valve 84 it pressurizes space 78 which provides a force in direction "b". This force overrides a spring 92, thus moving all dual wedges 14 into socket 16. This movement forces swage pins 10 outward through the hole in shaft B allowing a clamping action on a sleeve, such as a paper core which holds material as it winds up. This embodiment is advantageous in applications where the core is to remain clamped over a long time. To release the core, the air valve is manually opened.

Figure 5:
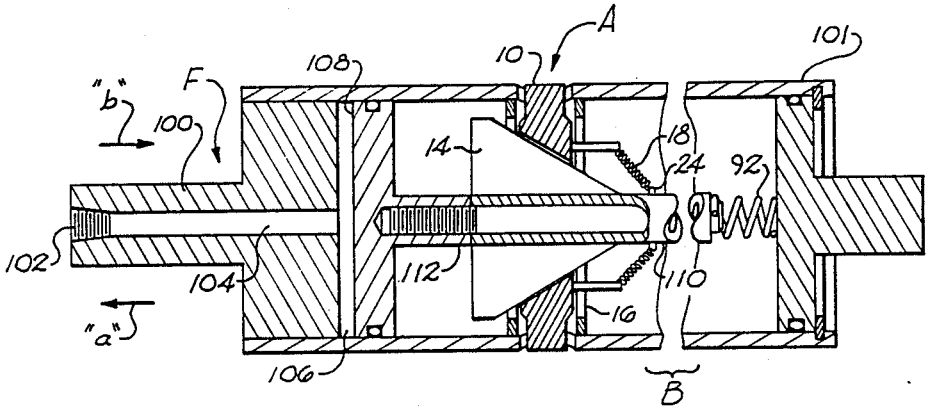
FIG. 5 is a sectional view of another embodiment of an expandable shaft according to the invention.

As can best be seen in FIG. 5, another embodiment of an assembly of dual wedge expansion unit A is shown with an operator means F mounted in a cantilever shaft B mounted by bearings (not shown) on journal 100. This leaves opposite end 101 open to load and unload material without removing the shaft. This embodiment provides for automatic clamping and unclamping of cores. With this type operation an air rotatory union connected at 102 with a hole 104 allows air to pressurize space 106. This force moves a piston 108 which connects to expansion unit A in direction "b" to move wedge means 14 into socket 16 again. Swage pins 10 extend through the holes in shaft B producing an expansion in diameter for clamping external accessories. Expansion unit A is connected to piston 108 by means of an operator rod 110 threaded into a piston rod 112. Dual wedges 14 are fixed to rod 110. When air is removed from hole 104 and space 106, piston 108 returns in direction "a" to move wedge 14 to the left, allowing swage pins 10 to retract radially under the force of springs 18. Pressurized fluid from a source 114 may be admitted into space 106 and vented automatically to release the shaft from its expanded position. This embodiment is advantageous when it is desired to repeatedly clamp and unclamp a core in rapid, short cycles or time periods. In particular, the shaft may be operated from a remote location and in large numbers such as when it is desired to doff a large number of textile bobbins.

While a preferred embodiment of the invention has been described using specific terms, such description is for illustrative purposes only, and it is to be understood that changes and variations may be made without departing from the spirit or scope of the following claims.

What is claimed is:

1. A radially expandable shaft for engaging an inner core of wound material and the like comprising in combination:

a hollow shaft;

an operator rod carried coaxially within said shaft;

expansion means carried within said shaft connected to said operator rod for expanding said shaft radially; and operator means connected to said operator rod, said operator means including an operator member movable axially with respect to said shaft, said operator member having a first position in which said operator rod may be rotated to cause said expansion means unit to expand and retract said shaft radially, said operator member moving axially to said first position while said operator rod is stationary and afterwards said operator member and said operator rod are rotatable together, and said operator member having a second axial position in which said operator member and rod are locked against rotation to maintain said shaft expanded.

2. The apparatus of claim 1 wherein said operator member is coupled with said operator rod in said first position, said operator member and operating rod rotating in unison to expand and retract said expansion means in said first axial position, and said operator member being coupled with said operator rod to lock it against rotation in said second axial position to prevent rotation of said operator member and operator rod.

3. The apparatus of claim 2 wherein said operator means includes first socket carried for rotation with said operator rod and a second socket which is fixed relative t the rotation of said operator member and rod, and said operator member includes a locking nut received in said first socket in said first axial position, and said locking nut is partially received in said first socket and said second socket in said second axial position.

4. The apparatus of claim 3 wherein said operator member is a locking nut having planar sides which form intersecting angle to define sharp locking edges.

5. The apparatus of claim 4 wherein said first and second sockets have planar walls defining intersecting corners which vaguely set said intersecting locking edges of said locking nut.

6. The apparatus of claim 3 including biasing means for biasing said locking nut in said second axial position.

7. A radially expanding shaft for engaging an inner core of wound material and the like comprising in combination:

a cylindrical shaft;

an operator rod carried coaxially within said shaft;

at least one expansion unit carried within said expandable shaft having a retaining socket, a plurality of radially expandable pins slidably carried by said retaining socket for reciprocating radial movement, a corresponding number of wedge means carried by said operator rod for engaging respective ones of said pin means for urging said pin means in an outward radial direction, and slot means formed in said retaining socket for slidably receiving said wedge means in an axial direction; and operator means operatively connected to said operator rod for moving said wedge means in reciprocating axial movements to urge said pin means radially when moved in a first direction and allow retraction of said pin means when moved in a second direction.

8. The apparatus of claim 7 wherein said operator means includes an operator member movable axially with respect to said shaft, said operator member having a first position in which said expansion unit expands said shaft radially, said operator member having a second axial position in which said expansion unit retracts said shaft.

9. The apparatus of claim 7 wherein said retaining socket includes radial bores formed around a circumference of said socket, said wedge means comprises a pair of wedges disposed generally orthogonal with respect to each other, said socket including a pair of generally orthogonal slots for receiving said generally orthogonal pair of wedges for engaging said pins received in said radial bores.

10. The apparatus of claim 8 including biasing means operatively connected to said pin means for retracting said pin means when said operator rod is moved in said second direction.

11. The apparatus of claim 7 wherein said operator means includes a piston carried by said operator rod and admission means for admitting air to said shaft for exerting a force on said piston to urge said operator rod in said first direction to cause pin means to expand radially.

12. The apparatus of claim 11 wherein said operator means includes an air chamber in which said piston is slidably received, and said admission means includes a manually operable air valve for admitting and venting air into and out of said air space.

13. The apparatus of claim 11 wherein said admission means includes means for automatically maintaining a pressurized source of fluid in contact against said piston, and for relieving said pressurized to release said piston and expanded shaft from said expanded position.

14. An expandable shaft for clamping a core comprising at least one expansion unit carried in said shaft having a plurality of swage pins expandable in a radial direction and wedge means for urging said pins radially; operator means carried by said shaft for moving said wedge means axially to expand and retract the pins; and locking means included in said operator means which may be rotated to move said wedge means axially; said locking means having a first axial position in which the operator means rotates to move said wedge means axially and a second axial position in which the operator means is positively locked against rotation so that the operator means cannot turn to loosen the clamping action of the pin against a core.

15. The apparatus of claim 14 including a journal carried by said shaft for carrying said shaft in a cantilevered manner, and said operator means being carried by said shaft near said journal so that said shaft may be operated from said journal end.

* * * * *